US005984744A

United States Patent [19]

Lutz

[11] Patent Number: 5,984,744

[45] Date of Patent: Nov. 16, 1999

[54] FLOTATION DEVICE WITH PORTABLE MIST SPRAY

[76] Inventor: Gary R. Lutz, 7205 Thomas Dr., Unit #A-508, Panama City Beach, Fla. 32408

[21] Appl. No.: 09/244,825

[22] Filed: Feb. 4, 1999

[51] Int. Cl.[6] ..... B63C 9/08

[52] U.S. Cl. ..... 441/129

[58] Field of Search ..... 441/129–131; 5/417–423; 4/496

[56] References Cited

U.S. PATENT DOCUMENTS

| | | | |
|---|---|---|---|
| D. 387,271 | 12/1997 | Bifulco . | |
| 4,648,143 | 3/1987 | Breaux et al. . | |
| 4,876,756 | 10/1989 | Vaccaro | 441/129 |
| 5,027,455 | 7/1991 | Commisso et al. . | |
| 5,233,705 | 8/1993 | Coleman et al. . | |

*Primary Examiner*—Ed Swinehart
*Attorney, Agent, or Firm*—William B. Noll

[57] ABSTRACT

A portable and low-cost flotation device consisting of a high density mat sized to accommodate a user while floating, a cooled head rest and a portable, hand held misting spraying mechanism which may be removably secured to the mat during periods of nonuse. The head rest includes a water containing cavity in communication with the spraying mechanism, and a foot activated pneumatic pump to pressurize the cavity to transmit the water to the spraying mechanism. The head rest further features a closable recess to receive a frozen ice pack to maintain the cavity water cool for a prolonged period of time, and at least one recessed cradle to receive a beverage can.

9 Claims, 4 Drawing Sheets

FLOTATION DEVICE WITH PORTABLE MIST SPRAY

FIELD OF THE INVENTION

The present invention is directed to an inexpensive and portable flotation device having a hand held water mist spraying mechanism as a means to cool a person reclining on the flotation device.

BACKGROUND OF THE INVENTION

This invention relates to an inexpensive recreational flotation device that may be readily transported to the beach, pool, etc., where the user is assured of cooling comfort from a hand held mist spraying mechanism. The device includes a cooled head rest integral with a high density flotation mat.

The prior art offers several devices that may provide some cooling comfort to a user of the device. The prior art is exemplified by the following U.S. Patents:

a.) U.S. Pat. No. 5,233,705, to Coleman, et al., discloses an inflatable raft with a shower device. The device includes a horizontally disposed support base having at least one flotation cell. At least one side wall of a shade member extends upwardly from the support base. The shade member further includes a horizontally disposed covering member supported by the at least one side wall. The support base and the shade member have at least one common inflatable air cell, such that full inflation of the air cell forces the side wall and the covering member to assume semi-rigid positions relative to the base for shading the base. The base has a support surface and perimeter walls extending above the support surface so that the base may retain water on the support surface between the perimeter walls. A water nozzle is further included and held by the covering member in a downwardly facing attitude. A flexible hose is positioned within the at least one air cell, and a hose coupling is positioned on the base. The hose interconnects the water nozzle and the hose coupling so that water may be introduced at the hose coupling to flow through the flexible hose for expulsion from the water nozzle for cooling a person reclining on the support base. A water reservoir is removably attached to the base, and includes a manual spray gun for producing a water spray for further cooling a person reclining on the base.

b.) U.S. Pat. No. 5,027,455, to Commisso, et al., teaches a misting device, usable with a lounging pad that produces a gentle blanket-like mist that completely covers sunbathers and provides cooling to keep a person comfortable while sunbathing without having to move away from the device. The misting device is removably attachable to a lounge pad and has mist emitting heads which are individually rotatable to control the direction of mist emission. While the device is attached to a lounge pad, the lounge pad may be folded for transport or to conform to the shape of lounge chairs or ground surface contours.

c.) U.S. Pat. No. 4,648,143, to Breaux et al., relates to sunbathing apparatus comprising a generally rectangular flexible sheet having an elongated flexible water conduit integrally attached to a marginal side edge thereof The conduit and the marginal side edge have a plurality of spaced concentric perforations therealong where the perforations are positioned toward the upper surface of the sheet member. A valve is provided for coupling the conduit to an operative supply of water and controlling the rate of flow of water, whereby water flowing into the conduit and out through the perforations is directed upwardly and inwardly of the marginal side edge of the sheet member so as to direct a fine spray of water onto the upper surface of the sheet member.

d.) U.S. Pat. No. D-387,271, to Bifulco, is a design patent which illustrates a portable spherical misting device.

In contrast to the foregoing prior art, the present invention offers a user of the device hereof a low-cost alternative to provide cooling comfort at a sunny beach, for example. The manner by which this goal is achieved with the present invention will become apparent to those skilled in the art from the following specification, particularly when read in conjunction with the accompanying drawings.

SUMMARY OF THE INVENTION

This invention relates to a low-cost, portable flotation device comprising an elongated, high density flotation mat having a head rest mounted at a first end thereof. The head rest includes upper and lower intermatable, shell-like housing members to form an internal cavity therebetween. The lower member is secured to the mat, and the upper member is configured with a recessed central portion for receiving the reclining head of the user, and a pair of wing portions extending from the recessed portion. The head rest further includes means for adding water to the cavity, with pneumatic means for placing the contained water under pressure. A feature of the device is a mobile, hand held spraying mechanism in communication with the water containing cavity, where a user of the device may interrittantly spray himself with a cooling water mist. Additional features of the device include an external recess in the lower member to receive an ice pack to cool the water and keep it cool for a prolonged period. Further, the upper member, in the respective wing portions, may include external recesses to cradle plural cans of liquid refreshment.

Accordingly, an object of this invention is to provide a user thereof with a portable device to provide cooling comfort at the beach.

A further object hereof is the provision of a hand held spraying mechanism that is simply operated by the user.

Another object of the invention is a cooled water housing having recesses therein for receiving and maintaining cans of cold drinks.

These and other objects will become apparent to those skilled in the art from the description which follows.

DETAILED DESCRIPTION OF PREFERRED EMBODIMENT

Figure 1:
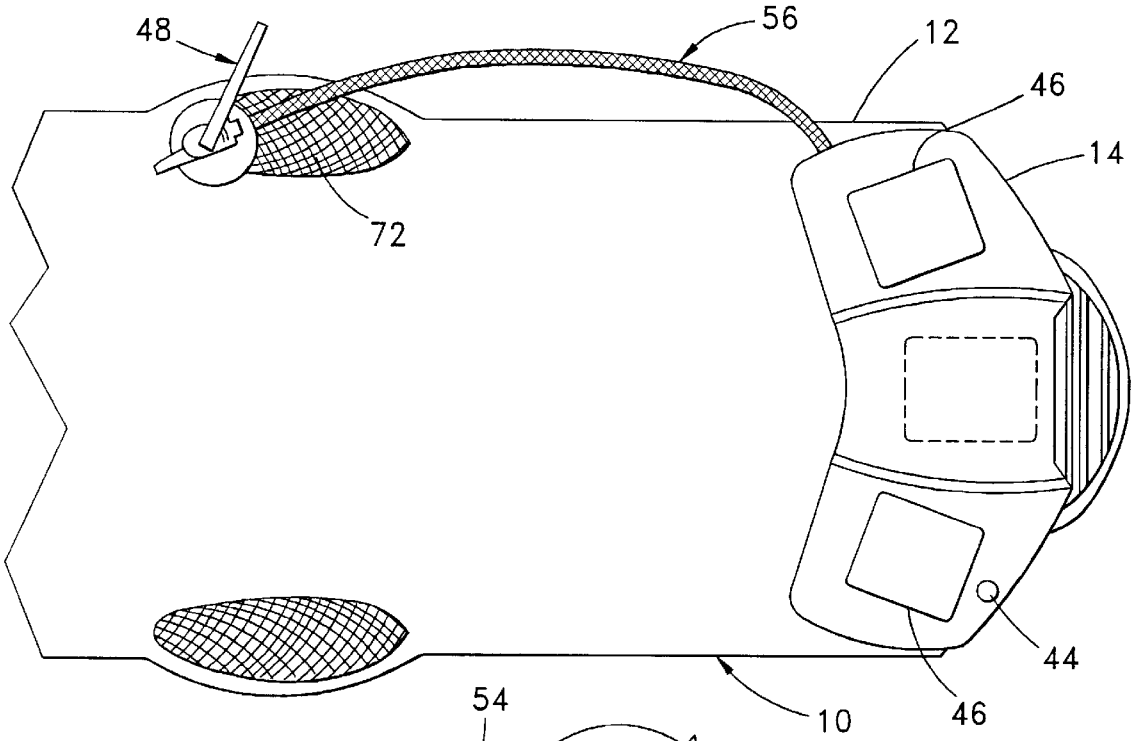
FIG. 1 is a top plan view of the flotation device with a portable mist spraying mechanism according to the present invention.

The present invention is directed to a portable, low-cost, recreational flotation device that offers convenience and cooling comfort to the user thereof. The device will now be described with reference to the accompanying Figures, where like reference numerals represent like components or features throughout the several views.

Figure 2:
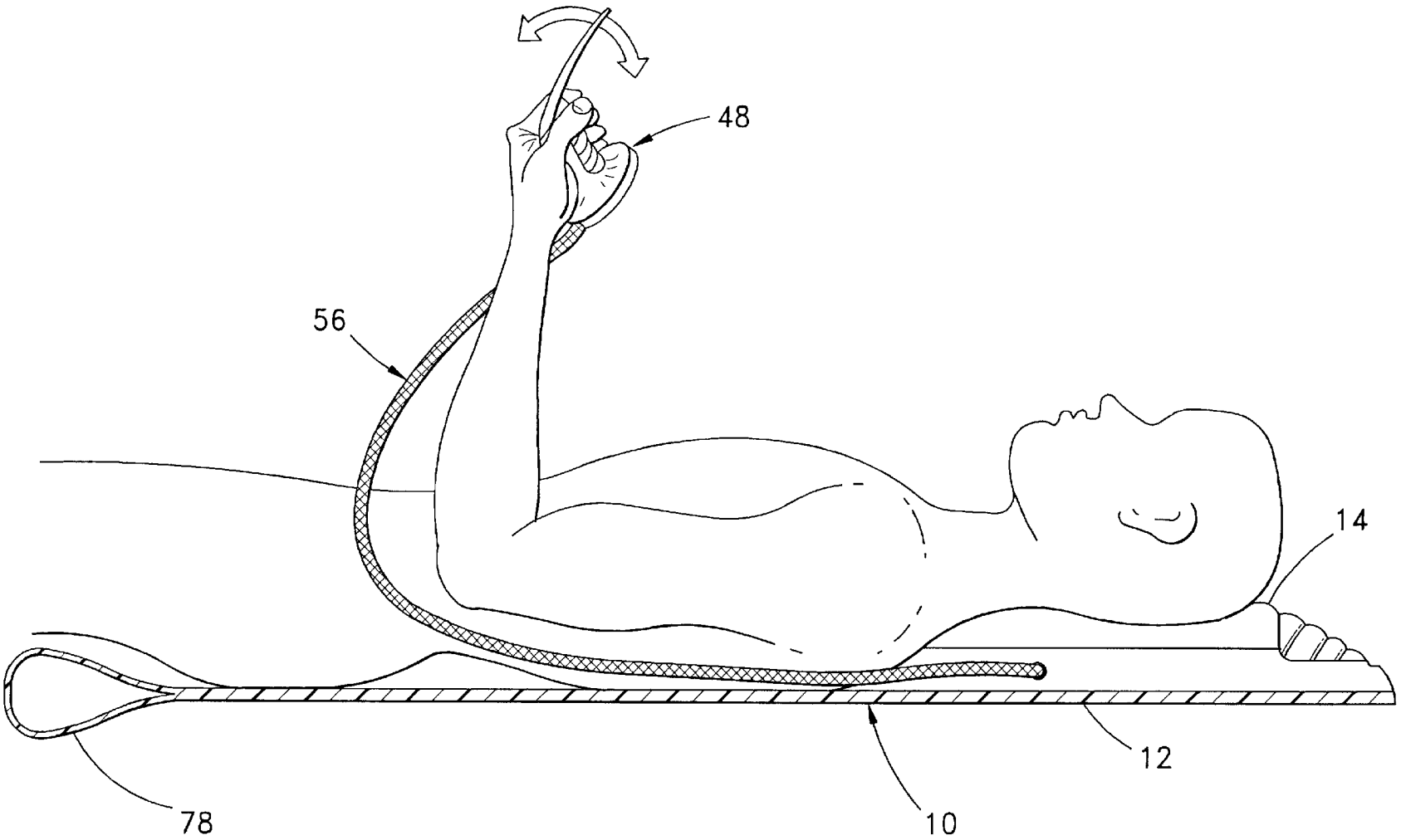
FIG. 2 is a side view thereof, further showing a person reclining on the flotation device and holding the portable mist spraying mechanism.

FIGS. 1 and 2 illustrate, respectively, top and side views of the flotation device 10 according to this invention. The flotation device 10 comprises a high density flotation mat 12, preferably elongated and rectangularly configured to comfortably support an adult in a water floating position, and a head rest 14 secured at one end of the mat 12.

Figure 3:
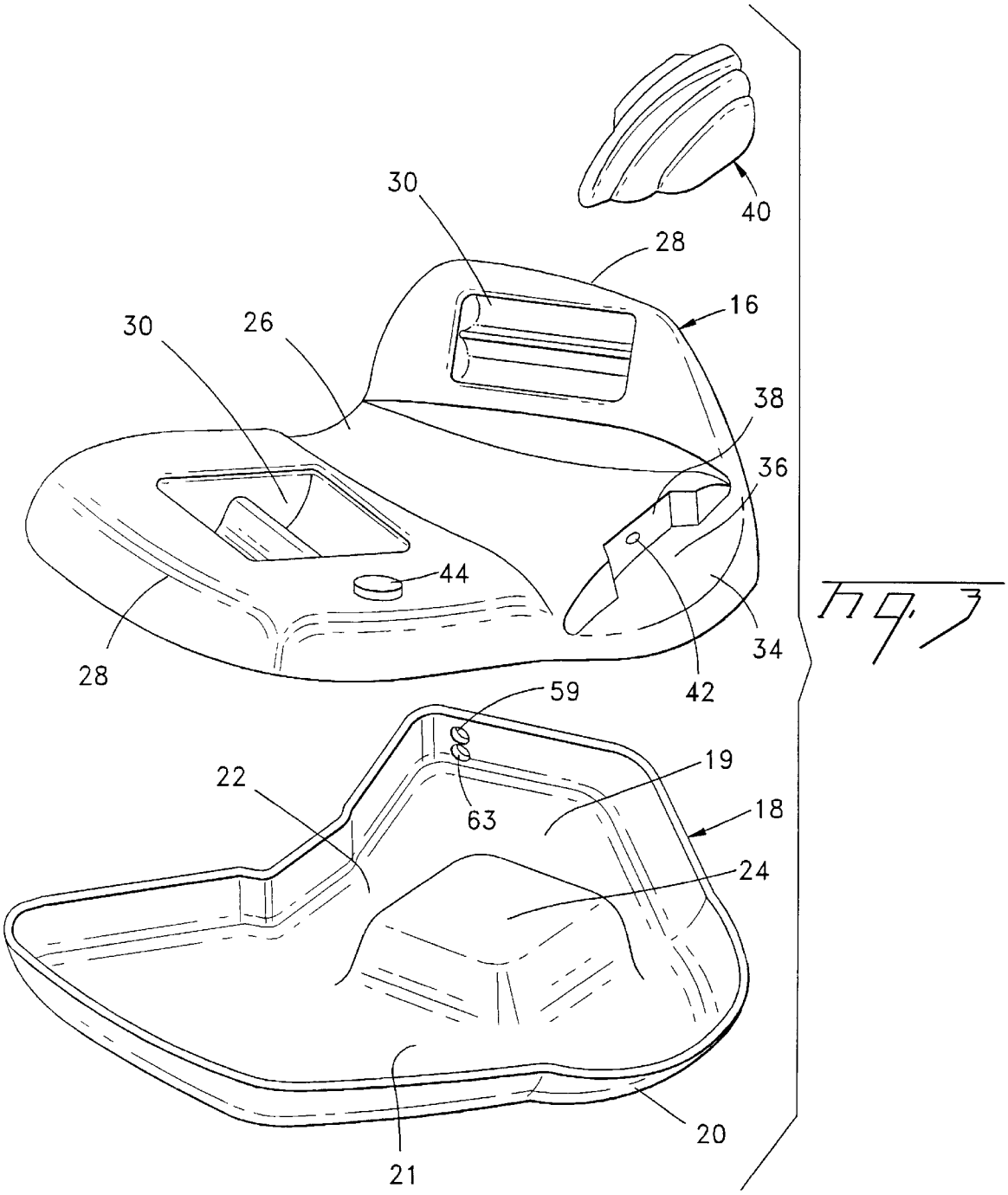
FIG. 3 is an exploded perspective view of the components or shells forming the head rest portion for the flotation device of this invention.
Figure 4:
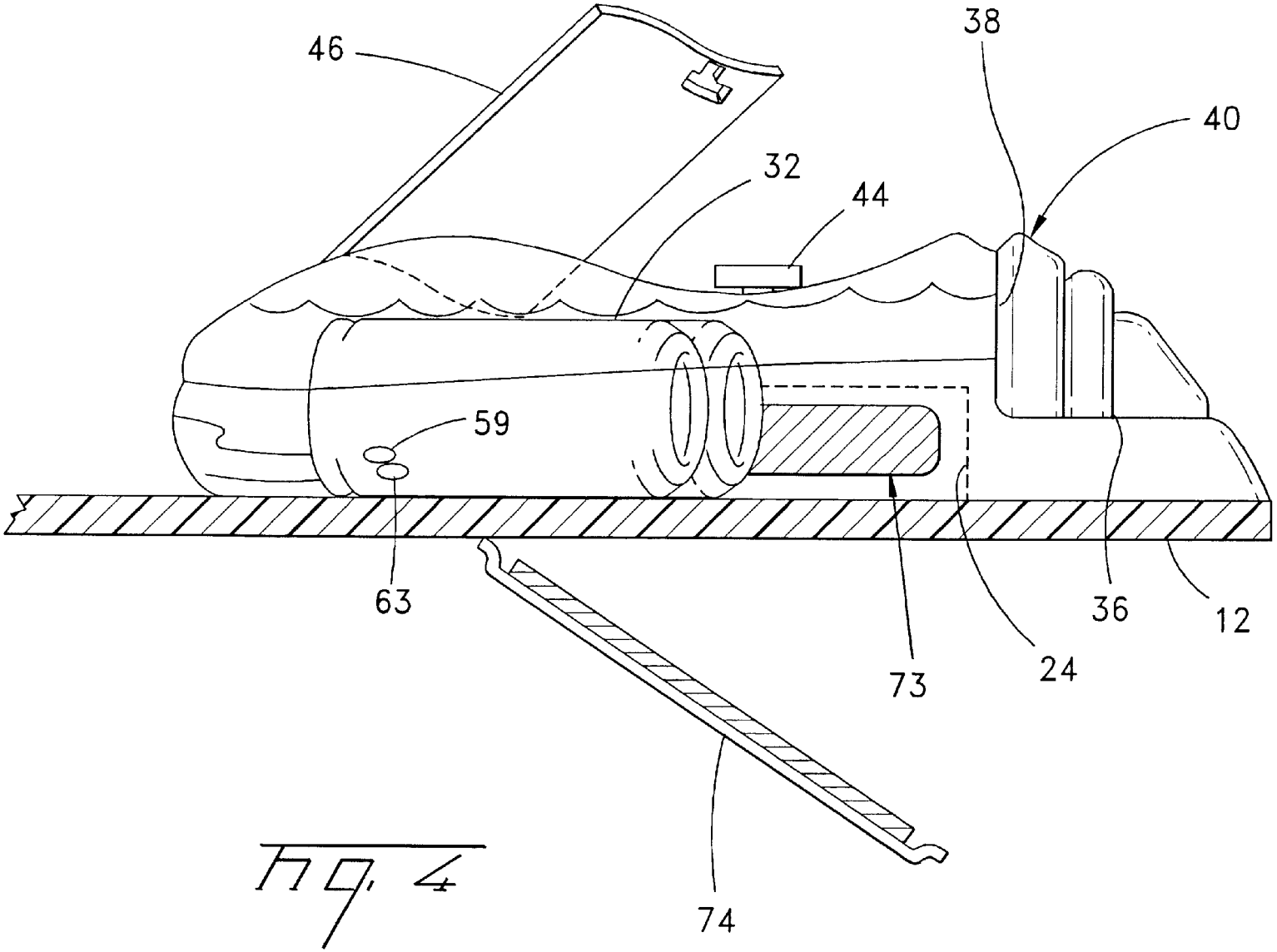
FIG. 4 is a side view of the assembled shell members of FIG. 3, with parts removed and/or shown in phantom to illustrate internal details.

The head rest 14, as further illustrated in FIGS. 3 and 4, preferably comprises upper and lower, intermatable shell members 16, 18, respectively, which form an integral housing unit defining a cavity 19 therebetween, as more clearly explained hereafter. The lower member 18 includes a continuous upstanding wall 20 from a base 21, and a central portion 22 in which an external recess 24 is provided in the base 21, where said recess 24 is intended to receive a frozen ice pack, as known in the art, as more fully explained hereafter.

The upper member 16 includes a central recessed section 26 with a pair of wing sections 28, preferably extending at an angle to said recessed section 26. The wing sections 28, as best seen in FIG. 3, may include a pair of recessed cradles 30 of a size to receive two conventional beverage cans 32, see FIG. 4. Further, extending from the central recessed section 26 is a ledge portion 34 defined by a base 36 and an upstanding wall 38. The ledge portion 34 is intended to receive a flexible bladder member 40, in communication with the cavity 19 through aperture 42, where the bladder member 40 functions as a foot activated pneumatic pump for reasons to be discussed in the description to follow. Further, with the respective members 16, 18 formed into an integral housing unit, access means, such as in the form of a closable opening 44, is provided to substantially fill the cavity 19 with water, note the indicated water level in FIG. 4. Finally, also as shown in FIG. 4, the recessed cradles 30 may include hinged covers 46 to further insulate the beverage cans 32 from the heat of the sun.

Figure 5:
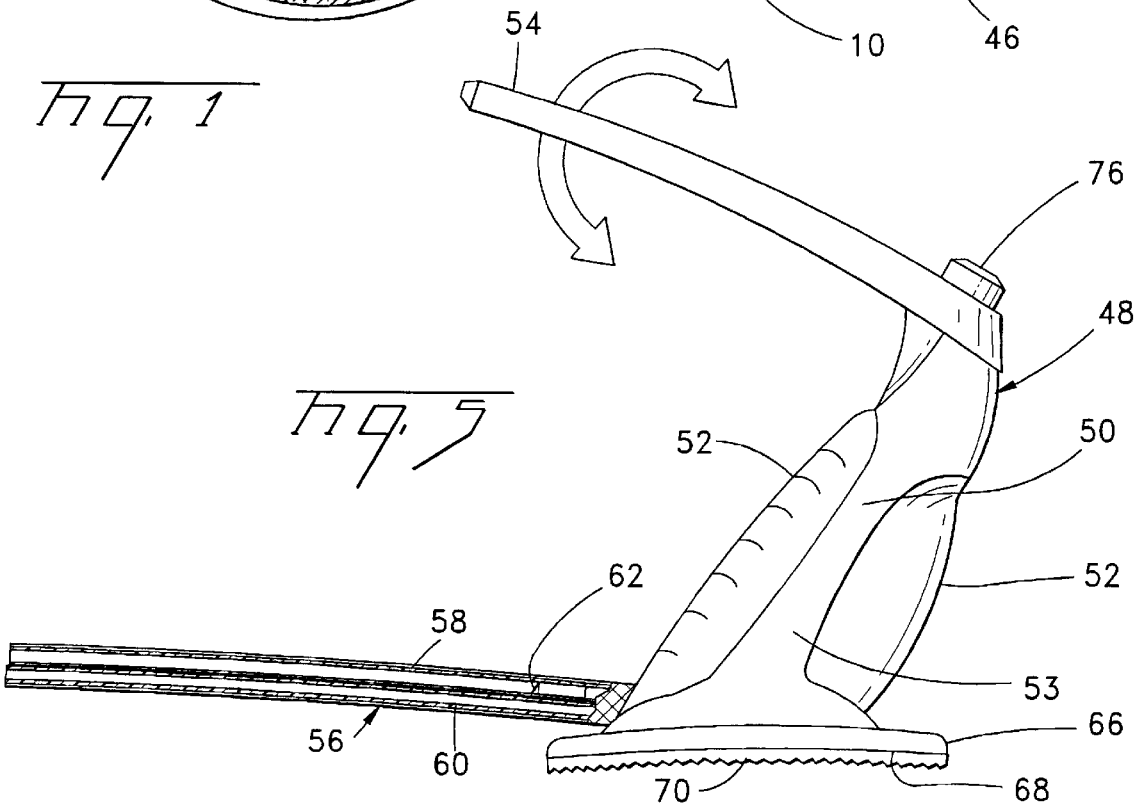
FIG. 5 is an enlarged side view of the portable mist spraying mechanism in accordance with this invention.

FIG. 5 illustrates an important feature of this invention. Since intermittant cooling of the user's body is particularly desirable in the hot sun (FIG. 2), a mist spraying mechanism 48 may be provided. The spraying mechanism 48 includes a semi-rigid handle member 50 mounting a pair of compressable bladder walls 52, which cooperate with the handle member to provide a depressible chamber 53 therewithin, a rigid spray nozzle 54, and a flexible hose 56 extending between said spraying mechanism 48 and said water filled cavity 19. The flexible hose 56 has dual lines 58, 60, where a first said line 58 transmits water from the cavity 19, through aperture 59, to the spray nozzle 54 via a one way valve 62. The second line 60, in communication with the bladder cavity 53, is a compression line that allows the user to apply compressive pressure to the water of cavity 19, via aperture 63, which in turn maintains the water pressure of water passing through line 58. Finally, to temporarily secure the spraying mechanism 48 during periods of nonuse, the spraying mechanism 48 may include a base 66 whose lower surface 68 is provided with a hook and pile, fabric type fastening member 70, a commercial product being known as VELCRO, a trademark. As noted in FIG. 1, the mat 12 may be provided with a complementary hook and pile, fabric type fastening member 72 upon which the spraying mechanism 48 may be temporarily secured.

To set up and use the device 10 of this invention, water is poured into the cavity 19 through closable opening 44. Thereafter, the foot pump or flexible bladder member 40 may be repeatedly depressed to put the water in cavity 19 under pressure. To ensure maintenance of such pressure, a oneway, flexible butterfly valve, or the like, may be provided in the aperture 42. To enhance one's comfort and enjoyment of the device 10, a frozen ice pack 73 may be placed in the recess 24, and secured therein by an insulated access door 74. Within the head rest 14 prepared as above, and pressurized, the device 10 may then be used as a floating mat by the user. And, if desired, the user may bring along with him/her some selected beverages, which should remain relatively cool due to the cold water below the beverage cradles. While floating, one will naturally spray oneself with the cooling mist from the hand held spraying mechanism 48. To maintain adequate pressure on the water in cavity 19, the spraying mechanism, or more precisely the depressible chamber 53 may be manually squeezed to build up and maintain the desired pressure. When the time arrives to return home, the user may relieve the built up pressure by the air release valve 76. Thereafter, any water remaining in the cavity 19 may be emptied through closable opening 44, and the device toted away for use at another time.

As an optional design feature, as best seen in FIG. 2, the foot end of the mat 12 may be provided with a reverse turned end 78, which would normally be positioned under the user's knees, to provide balance and support to the user while floating.

It is recognized that changes, modifications and variations may be made in the design and construction of the flotation device of this invention particularly by those skilled in the art, without departing from the spirit and scope thereof. Accordingly, no limitation is intended to be imposed on this invention except as set forth in the accompanying claims.

I claim:

1. A flotation device comprising an elongated, high density flotation mat having a head rest mounted at a first end thereof, said head rest comprising upper and lower intermatable, shell-like, housing members to form an integral unit having an internal cavity therebetween, where said lower member is secured to said mat, said upper member being configured with a recessed central portion for receiving a user's reclining head, and a pair of wing portions extending therefrom, said head rest further including means for adding water to said cavity with pneumatic means for placing said water under pressure; and, a mobile, hand-held spraying mechanism and nozzle in communication with said water containing cavity, where a user of said device may intermittantly spray the user with a cooling mist.

2. The flotation device according to claim 1, wherein said lower member includes a recess underlying said central portion of said upper member, said recess sized to receive a frozen ice pack to facilitate cooling of water within said cavity.

3. The flotation device according to claim 2, wherein said recess includes a removable cover accessible through said mat.

4. The flotation device according to claim 1, wherein said upper member includes at least one cradle recess to receive a beverage can.

5. The flotation device according to claim 4, wherein said at least one said cradle recess includes a removable cover.

6. The flotation device according to claim 1, wherein said pneumatic means includes a foot depressible bladder member, positioned on said upper member in communication with said cavity.

7. The flotation device according to claim 1, wherein said spraying mechanism is in communication with said water containing cavity via a flexible hose where said hose includes a first conduit to deliver water to said spraying mechanism in a first direction, and a second conduit to deliver air under pressure in a reverse direction to said water containing cavity.

8. The flotation device according to claim 1, wherein said spraying mechanism includes a mounting base having a hook and pile, fabric type fastening member, and said mat includes a complementary hook and pile, fabric type fastening member to removably receive and secure said spraying mechanism.

9. The flotation device according to claim 1, wherein the end of said mat remote from said head rest includes a reversely bent section to provide added support to the user thereof.

* * * * *